US008676659B1

(12) United States Patent
Shnowske et al.

(10) Patent No.: US 8,676,659 B1
(45) Date of Patent: Mar. 18, 2014

(54) METHODS AND APPARATUSES FOR FACILITATING FINANCIAL TRANSACTIONS USING GAMER TAG INFORMATION

(75) Inventors: Daniel P. Shnowske, Waxahachie, TX (US); William Treadwell, Addison, TX (US)

(73) Assignee: Bank of America Corporation, Charlotte, NC (US)

( * ) Notice: Subject to any disclaimer, the term of this patent is extended or adjusted under 35 U.S.C. 154(b) by 454 days.

(21) Appl. No.: 12/508,368

(22) Filed: Jul. 23, 2009

(51) Int. Cl.
*G06Q 30/00* (2012.01)

(52) U.S. Cl.
USPC ..... 705/26.1; 705/26.35; 705/27.1; 705/27.2; 463/25

(58) Field of Classification Search
USPC ..... 705/26.1–27.2
See application file for complete search history.

(56) References Cited

U.S. PATENT DOCUMENTS

| | | | | |
|---|---|---|---|---|
| 5,835,603 | A | 11/1998 | Coutts et al. | |
| 6,417,869 | B1 | 7/2002 | Do | |
| 7,319,992 | B2 | 1/2008 | Gaos | |
| 2005/0226408 | A1 | 10/2005 | Hotz | |
| 2006/0247060 | A1 | 11/2006 | Hanson et al. | |
| 2006/0268896 | A1 | 11/2006 | Kotola et al. | |
| 2007/0021198 | A1 | 1/2007 | Muir et al. | |
| 2007/0087820 | A1 * | 4/2007 | Van Luchene et al. | 463/25 |
| 2008/0108426 | A1 * | 5/2008 | Nguyen et al. | 463/25 |
| 2009/0144193 | A1 | 6/2009 | Giordano et al. | |
| 2009/0273559 | A1 * | 11/2009 | Rofougaran et al. | 345/156 |

OTHER PUBLICATIONS

"Virtual Econmics" Campbell, Doug. Region Focus. 12.1 (Winter 2008): 18-22. Retreived via ProQuest.*
U.S. Appl. No. 12/345,339, filed Dec. 29, 2008, Shnowske, et al.
U.S. Appl. No. 12/345,343, filed Dec. 29, 2008, Shnowske, et al.

* cited by examiner

*Primary Examiner* — Michael Misiaszek
(74) *Attorney, Agent, or Firm* — Michael A. Springs; Moore & Van Allen PLLC; Esther F. Queen

(57) ABSTRACT

Embodiments of the present invention relate to methods and apparatuses for performing financial transaction using gamer tag information. For example, in one embodiment, a method is provided to: (1) receive information associated with a first gamer tag and information associated with a proposed financial transaction; (2) determine that the first gamer tag is associated with a first financial account; and (3) facilitate the proposed financial transaction, wherein the proposed financial transaction involves the first financial account.

22 Claims, 4 Drawing Sheets

METHODS AND APPARATUSES FOR FACILITATING FINANCIAL TRANSACTIONS USING GAMER TAG INFORMATION

FIELD

In general terms, embodiments of the present invention relate to methods and apparatuses for performing, executing, brokering, processing, initiating, completing, and/or otherwise facilitating financial transactions using gamer tag information.

BACKGROUND

Conventional financial transaction and/or payment systems typically require at least one of the parties involved in the transaction to provide and/or expose personal and/or financial information to the system and/or to other parties involved in the transaction before the system will execute the transaction. As such, these conventional transaction and/or payment systems are inconvenient and, with the rise of identity theft, may also be unacceptably unsecure. Accordingly, it is desirable to provide systems and associated methods and apparatuses for performing, executing, brokering, processing, initiating, completing, and/or otherwise facilitating financial transactions that limit the exposure of personal and/or financial information. It is also desirable provide systems and associated methods and apparatuses to allow people to make financial transactions in increasingly new ways, environments, and contexts.

SUMMARY OF SELECTED EMBODIMENTS OF THE PRESENT INVENTION

Embodiments of the present invention relate to methods and apparatuses for performing, executing, brokering, processing, initiating, completing, and/or otherwise facilitating financial transactions using gamer tag information. For example, in one embodiment, a system is provided that includes: (1) a communication interface configured to receive, from a gaming device, information associated with a first gamer tag and information associated with a proposed financial transaction; and (2) a processor configured to determine that the first gamer tag is associated with a first financial account, and wherein the processor is further configured to facilitate the proposed financial transaction, wherein the proposed financial transaction involves the first financial account.

In some embodiments, the gaming device includes a gaming console. In some embodiments, the information associated with the first gamer tag is received from a first gaming device and the information associated with the proposed financial transaction is received from a second gaming device. In some embodiments, the processor is configured to execute the proposed financial transaction. In some embodiments, the processor is configured to facilitate the proposed financial transaction by communicating information associated with the proposed financial transaction and information associated with the first financial account to a computerized apparatus configured to execute the proposed financial transaction. In one embodiment, that computerized apparatus is maintained by a financial institution that maintains the first financial account.

According to some embodiments, the processor is configured to determine that the first gamer tag is associated with the first financial account based at least partially on a comparison of the information associated with the first gamer tag to information stored in a datastore, wherein the datastore includes information associated with a plurality of gamer tags and a plurality of financial accounts. In some embodiments, the communication interface is further configured to receive, from the gaming device, information associated with an authentication. In some embodiments, the processor is configured to determine that the authentication is associated with at least one of the first gamer tag, the gaming device, the first financial account, a gaming device user, or a financial institution that maintains the first financial account. In some embodiments, the authentication includes a gaming device identifier. In other embodiments, the authentication alternatively or additionally includes one or more gaming device-specific inputs.

In some embodiments, the first gamer tag exists in, or communicates with, a virtual environment. In some embodiments, the communication interface is operatively connected to the gaming device via the Internet, and the communication interface is configured to receive, from the gaming device via the Internet, the information associated with a first gamer tag and the information associated with a proposed financial transaction. In some embodiments, the proposed financial transaction includes at least one of purchasing a gaming product, transferring funds, or paying a bill. In some embodiments, the communication interface is further configured to receive information associated with a second gamer tag. Additionally or alternatively, in some embodiments, the processor is configured to determine that the second gamer tag is associated with a second financial account. In some embodiments, the proposed financial transaction further involves the second financial account. In some embodiments, the proposed financial transaction includes a funds transfer from the first financial account to the second financial account. In some embodiments, the first gamer tag is controlled by a first gaming device user, the second gamer tag is controlled by a business, and the proposed financial transaction includes purchasing a gaming product.

In another embodiment of the present invention, a system is provided that includes (1) a first communication interface in communication with a first gaming device, the first communication interface being configured to receive information associated with a first gamer tag from the first gaming device; (2) a second communication interface in communication with a second gaming device, the second communication interface being configured to receive information associated with a second gamer tag from the second gaming device; and (3) a processor operatively connected to the first communication interface and the second communication interface, the processor being configured to determine that the first gamer tag is associated with a first financial account and the second gamer tag is associated with a second financial account, in order to facilitate a financial transaction involving the first financial account and the second financial account.

In some embodiments, the first gaming device includes a first gaming console and the second gaming device includes a second gaming console. In some embodiments, the processor is configured to determine that the first gamer tag is associated with the first financial account based at least partially on a comparison of the information associated with the first gamer tag to information stored in a datastore, wherein the datastore includes information associated with a plurality of gamer tags and a plurality of financial accounts. In another embodiment, (1) the first or second communication interface is configured to receive, from the first or second gaming device, information associated with an authentication; and (2) the processor is configured to determine that the authentication is associated with at least one of the first gamer tag, the second gamer tag, the first gaming device, the second gaming device, the first financial account, the second financial account, a first gaming device user, a second gaming device user, a first financial institution that maintains the first financial account, or a second financial institution that maintains the second financial account.

In some embodiments, the first communication interface is maintained by a financial institution. In other embodiments, the first communication interface and the second communication interface are maintained by a single financial institution. In some embodiments, the first communication interface includes the second communication interface.

In another embodiment of the present invention, a method is provided that includes: (1) receiving, from a gaming console, information associated with a first gamer tag and information associated with a proposed financial transaction; (2) using a processor to determine that the first gamer tag is associated with a first financial account; and (3) facilitating the proposed financial transaction, wherein the proposed financial transaction involves the first financial account. In some embodiments, the using a processor to determine that the first gamer tag is associated with a first financial account is based at least partially on a comparison of the information associated with the first gamer tag to information stored in a datastore, wherein the information stored in the datastore includes information associated with a plurality of gamer tags and a plurality of financial accounts.

In some embodiments, the method further includes (1) receiving information associated with an authentication; and (2) determining that the authentication is associated with at least one of the first gamer tag, the gaming console, the first financial account, a gaming console user, or a financial institution that maintains the first financial account. In some embodiments, the method further includes: (1) receiving information associated with a second gamer tag; (2) determining that the second gamer tag is associated with a second financial account; and (3) facilitating the proposed financial transaction, wherein the proposed financial transaction further involves the second financial account. As an example, in one embodiment, the proposed financial transaction includes a funds transfer from the first financial account to the second financial account.

In another embodiment of the present invention, a method is provided that includes: (1) launching, on a gaming console, a financial services application; (2) establishing a network connection between the gaming console and a network device; and (3) communicating, from the gaming console to the network device via the network connection, information associated with a first gamer tag and information associated with a proposed financial transaction, the network device being configured to determine that the first gamer tag is associated with a first financial account and facilitate the proposed financial transaction, wherein the proposed financial transaction involves the first financial account. In some embodiments, the method further includes communicating, from the gaming console to the network device via the network connection, information associated with an authentication required by the network device to facilitate the proposed financial transaction.

In another embodiment of the present invention, a financial services application is provided. In one embodiment, the application is stored in memory on a computerized apparatus, and, upon receiving information associated with a first gamer tag and information associated with a proposed financial transaction, the financial services application is configured to: (1) determine that the first gamer tag is associated with a first financial account; and (2) use the first financial account to execute the proposed financial transaction. In some embodiments, the application is configured to determine that the first gamer tag is associated with a first financial account based at least partially on a comparison of the information associated with the first gamer tag to information stored in a datastore, wherein the information stored in the datastore includes information associated with a plurality of gamer tags and a plurality of financial accounts. In some embodiments, the application is further configured to receive information associated with an authentication and determine that the authentication is associated with at least one of the first gamer tag, a gaming console, the first financial account, a gaming console user, or a financial institution that maintains the first financial account.

In another embodiment of the present invention, a computer program product is provided. In one embodiment, the computer program product includes a computer-readable medium having computer-executable program code portions stored therein, wherein the computer-executable program code portions include: (1) a first program code portion configured to receive information associated with a first gamer tag and information associated with a proposed financial transaction; (2) a second program code portion configured to determine that the first gamer tag is associated with a first financial account; and (3) a third program code portion configured to facilitate the proposed financial transaction, wherein the proposed financial transaction involves the first financial account.

In some embodiments, the computer program product further includes: (1) a fourth program code portion configured to receive information associated with an authentication; and (2) a fifth program code portion configured to determine that the authentication is associated with at least one of the first gamer tag, the gaming console, the first financial account, a gaming console user, or a financial institution that maintains the first financial account. In some embodiments, the computer program product further includes: (1) a fourth program code portion configured to receive information associated with a second gamer tag; (2) a fifth program code portion configured to determine that the second gamer tag is associated with a second financial account; and (3) wherein the proposed financial transaction further involves the second financial account.

BRIEF DESCRIPTION OF THE DRAWINGS

Figure 1:
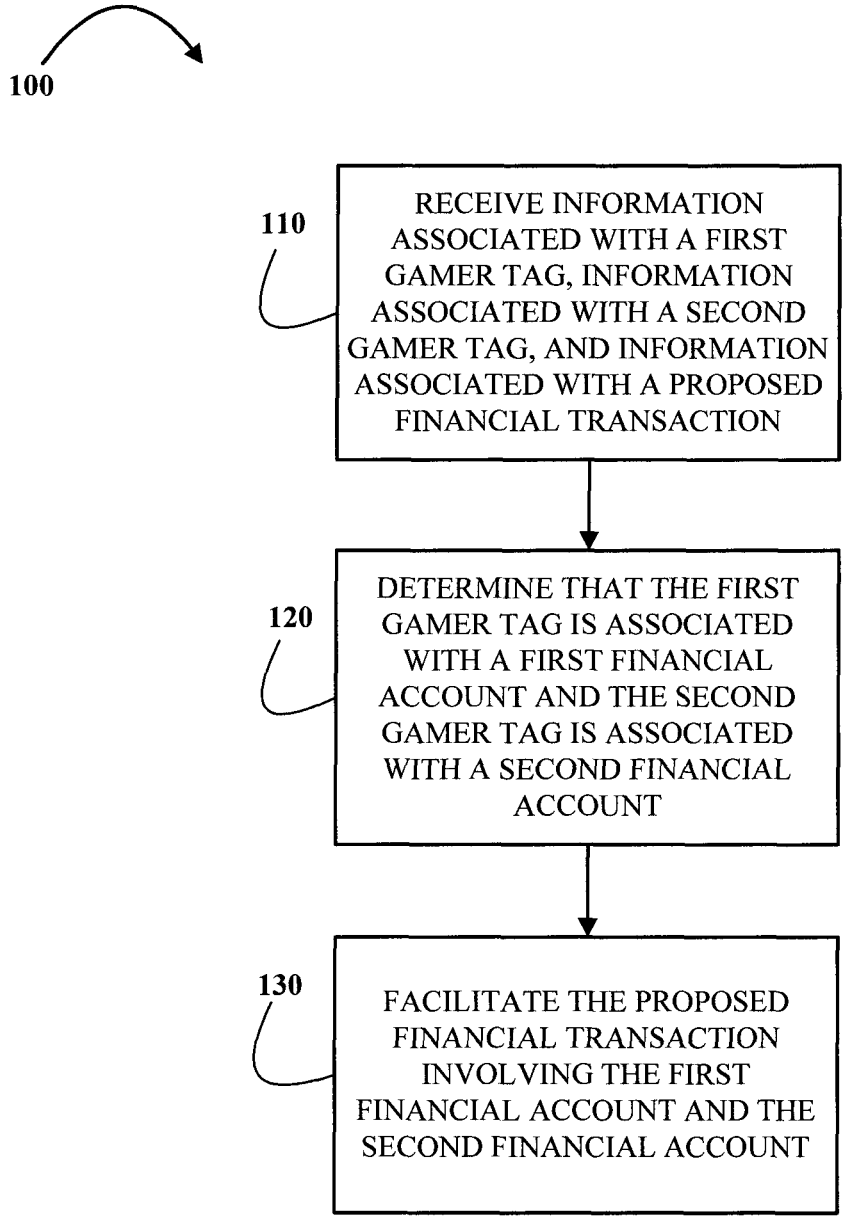
Figure 2:
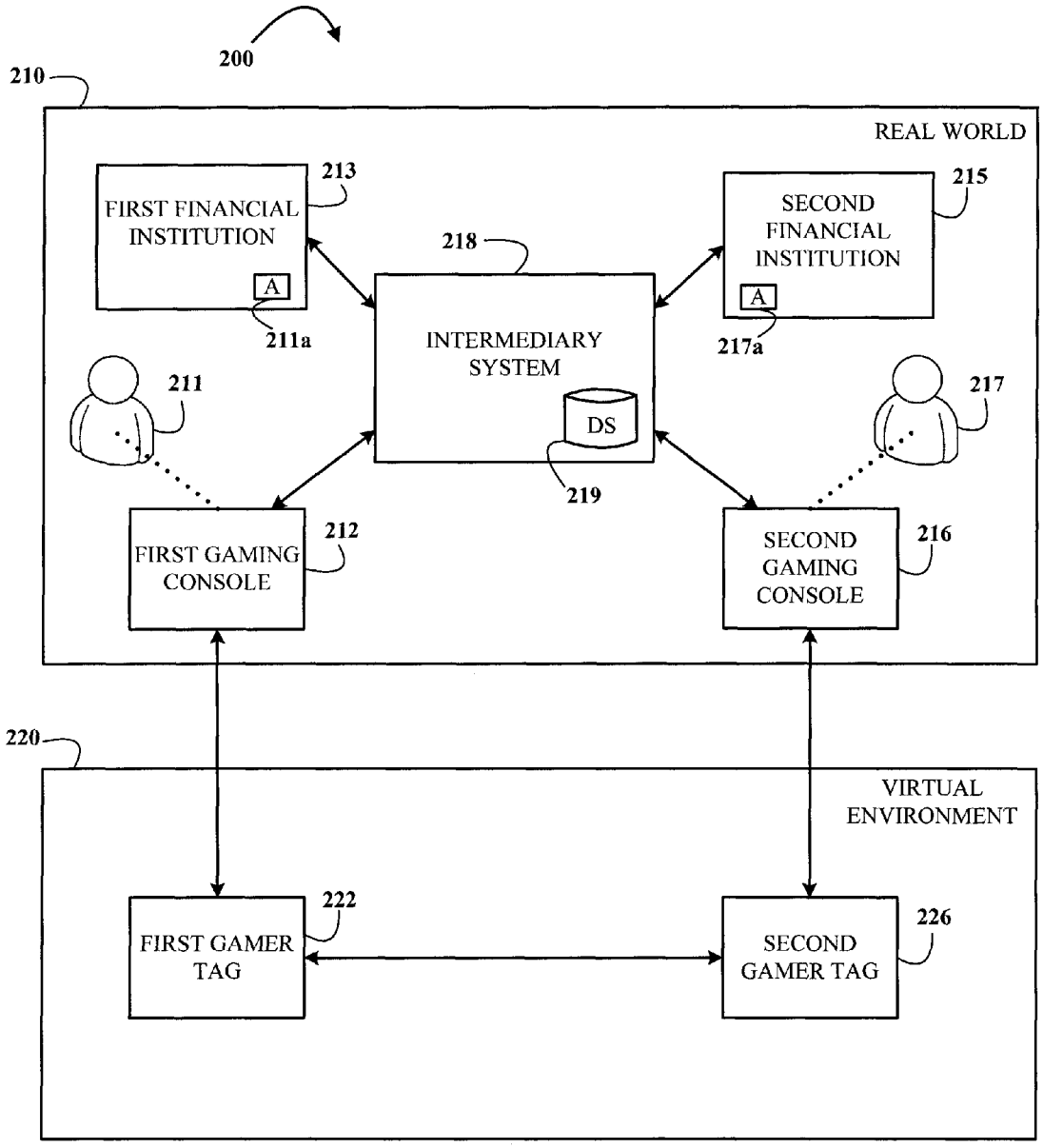
Figure 3:
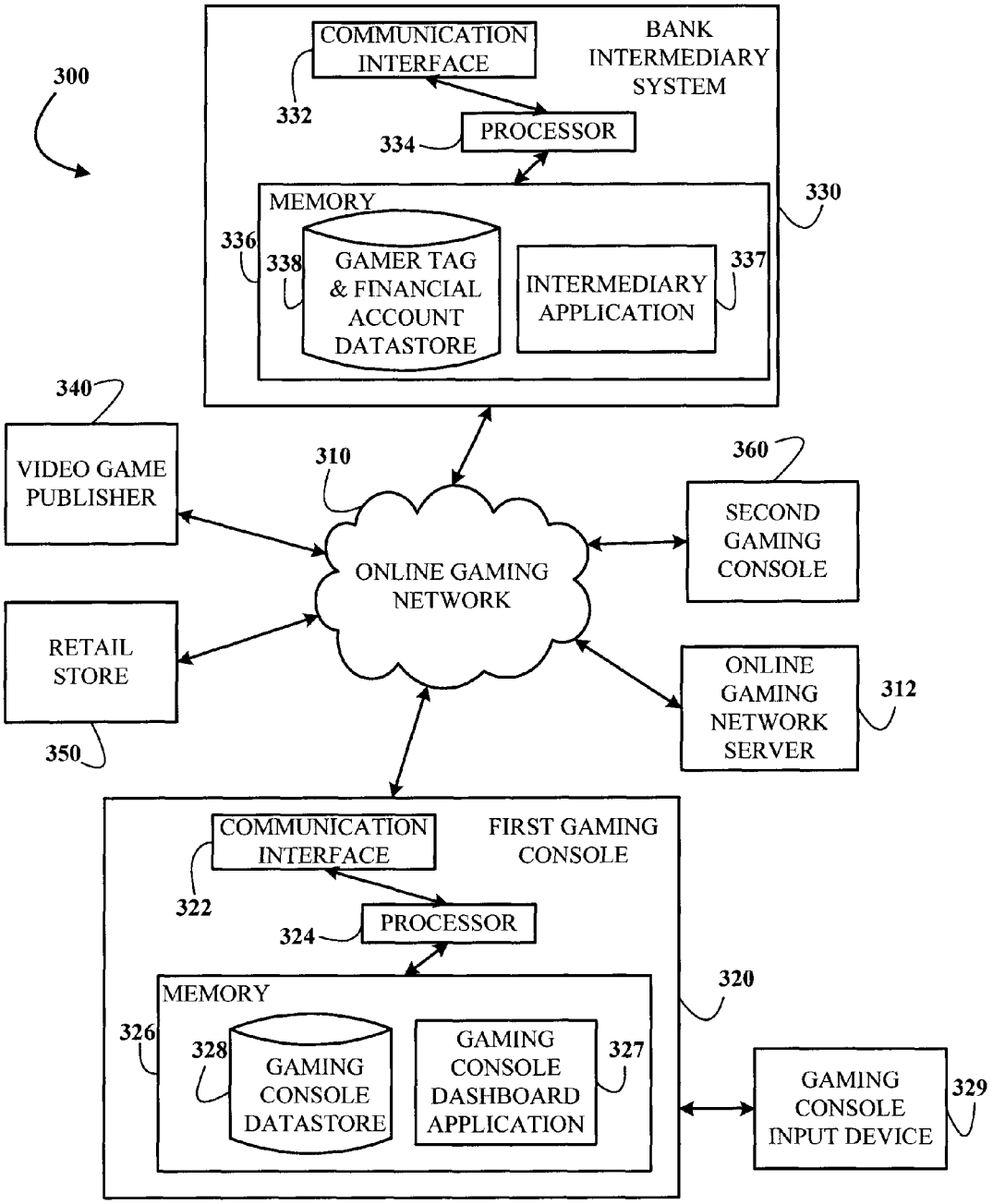
Figure 4:
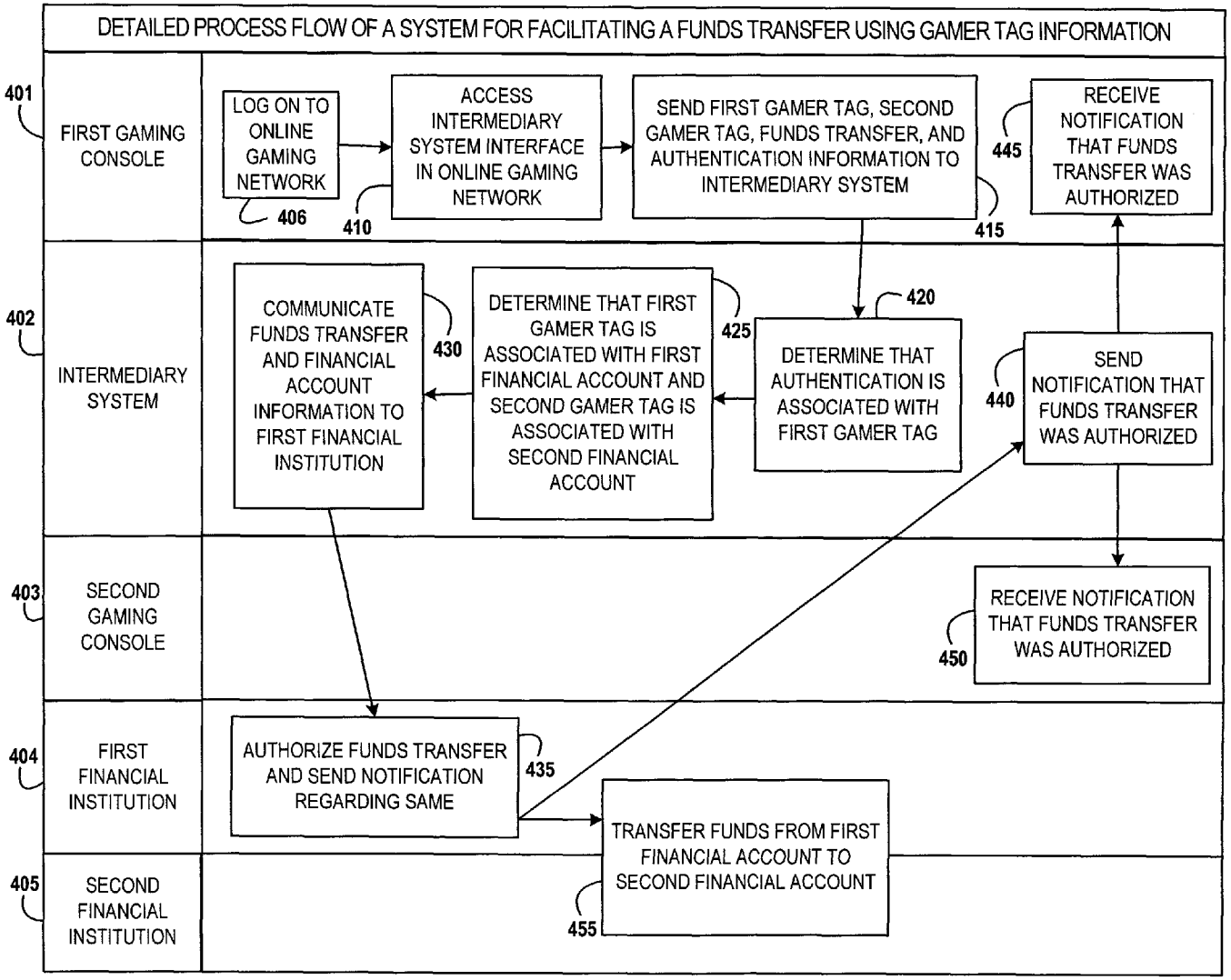

Having thus described embodiments of the present invention in general terms, reference will now be made to the accompanying drawings, wherein:

FIG. 1 is a flow diagram illustrating a general process flow of an intermediary system configured to facilitate financial transactions using gamer tag information, in accordance with an embodiment of the present invention;

FIG. 2 is a high-level block diagram illustrating a system configured to facilitate financial transactions using gamer tag information, in accordance with an embodiment of the present invention;

FIG. 3 is a block diagram illustrating technical components of a system configured to perform financial transactions using gamer tag information, in accordance with an embodiment of the present invention; and FIG. 4 illustrates a more detailed process flow of a system configured to facilitate a funds transfer from a first financial account to a second financial account using gamer tag information, in accordance with an embodiment of the present invention.

DETAILED DESCRIPTION OF EMBODIMENTS OF THE PRESENT INVENTION

Embodiments of the present invention will now be described more fully hereinafter with reference to the accompanying drawings, in which some, but not all, embodiments of the present invention are shown. Indeed, the present invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Like numbers refer to like elements throughout.

As will be appreciated by one of ordinary skill in the art in view of this disclosure, the present invention may be embodied as an apparatus (including, for example, a system, machine, device, computer program product, or any other apparatus), method (including, for example, a business process, computer-implemented process, or any other process and/or method), and/or any combination of the foregoing. Accordingly, embodiments of the present invention may take the form of an entirely software embodiment (including firmware, resident software, micro-code, etc.), an entirely hardware embodiment, or an embodiment combining software and hardware aspects that may generally be referred to herein as a "system." Furthermore, embodiments of the present invention may take the form of a computer program product having a computer-readable storage medium having computer-executable program code portions embodied in the medium. As used herein, a processor may be "configured to" perform a certain function in a variety of ways, including, for example, by having one or more general-purpose circuits perform the function by executing particular computer-executable program code embodied in computer-readable medium, and/or by having one or more application-specific circuits perform the function.

Any suitable computer-readable medium may be utilized. The computer-readable medium may be, for example but not limited to, an electronic, magnetic, optical, electromagnetic, infrared, and/or semiconductor system, apparatus, and/or device. For example, in one embodiment, the computer-readable medium includes a tangible medium such as a portable computer diskette, a hard disk, a random access memory (RAM), a read-only memory (ROM), an erasable programmable read-only memory (EPROM or Flash memory), a compact disc read-only memory (CD-ROM), and/or other tangible optical or magnetic storage device.

Computer-executable program code for carrying out operations of the present invention may be written in object-oriented, scripted and/or unscripted programming languages such as Java, Perl, Smalltalk, C++, SAS, SQL, or the like. However, the computer-executable program code portions for carrying out operations of the invention may also be written in conventional procedural programming languages, such as the "C" programming language and/or similar programming languages.

Some embodiments of the present invention are described herein with reference to flowchart illustrations and/or block diagrams of systems, methods, and computer program products according to embodiments of the invention. It will be understood that each block included in the flowchart illustrations and/or block diagrams, and combinations of blocks included in the flowchart illustrations and/or block diagrams, may be implemented by computer-executable program code. The computer-executable program code may be provided to a processor of a general purpose computer, special purpose computer, or other programmable data processing apparatus to produce a particular machine, such that the computer-executable program code portions, which execute via the processor of the computer or other programmable data processing apparatus, create mechanisms for implementing the functions and/or acts specified in the flowchart and/or block diagram block(s).

The computer-executable program code portions may also be stored in a computer-readable memory that can direct a computer and/or other programmable data processing apparatus to function in a particular manner, such that the instructions stored in the computer-readable memory produce an article of manufacture including instruction mechanisms which implement the function/act specified in the flowchart and/or block diagram block(s).

The computer-executable program code portions may also be loaded onto a computer or other programmable data processing apparatus to cause a series of operational steps to be performed on the computer and/or other programmable apparatus to produce a computer-implemented process such that the computer-executable program code which executes on the computer and/or other programmable apparatus provides steps for implementing the functions/acts specified in the flowchart and/or block diagram block(s). Alternatively, computer-implemented steps and/or acts may be combined with operator and/or human implemented steps and/or acts in order to carry out an embodiment of the present invention.

It will be understood that although many of the embodiments of the present invention described herein are generally described as involving "a bank" or "the bank," other embodiments of the invention may involve other financial institutions or businesses that take the place of, or work in conjunction with, the bank to perform one or more of the processes or events described herein as being performed by the bank.

It will also be understood that the phrase "financial account," as used herein, may include, for example, a checking account, deposit account, credit account, debit card account, credit card account, gift card account, savings account, money market account, and/or any other financial account that may be involved in a financial transaction. For simplicity, financial accounts are often referred to herein as being "maintained" by a bank, financial institution, or some other business, but it will be understood that "maintained" may also mean held, controlled, operated, managed, serviced, stored, maintained, and/or the like and/or any combination of the foregoing. It will also be understood that the phrase "financial account information", as used herein, may include any information associated with a financial account, including, for example, personal information (e.g., persons and/or entities associated with the financial account, addresses associated with the financial account, etc.), account type information (e.g., checking account, credit card account, etc.), account name information (e.g., "Bank A Platinum Credit Card", etc.), routing number and/or account number information, account balance information, financial transaction information (e.g., transaction amount, transaction date, parties involved in the transaction, type of transaction, etc.), information regarding which gamer tags and/or gaming devices and/or gaming device users are associated with the financial account, and/or the like.

It will be understood that the phrase "gaming device," as used herein, refers to a device configured to access and/or communicate with a virtual environment. Gaming devices are also typically configured to play video games. A gaming device may include, but is not limited to, a gaming console, personal computer, arcade game machine, mobile phone, public kiosk, and/or some other computerized apparatus configured to play video games and/or to access and/or communicate with a virtual environment.

Although any embodiment of the present invention may involve any gaming device, most of the embodiments described herein are described as involving a gaming console. Gaming consoles are characteristically defined as executing only signed code, and therefore, any program, application, and/or other software that is executed on a gaming console must include signed code and a corresponding digital certificate. As such, gaming consoles provide far greater security than other gaming devices, such as a personal computer (PC) or the like, which allows for both signed code and unsigned code to be executed on the gaming device, thereby compromising the security of the gaming device and the communications transmitted to and/or from the gaming device.

It will also be understood that the phrase "virtual environment," as used herein, may refer to one or more portions of a game world, virtual world, online gaming network, dashboard environment (e.g., a graphical user interface and/or virtual environment of a gaming console), local area network (LAN), wide area network (WAN), global area network (GAN), Internet, network environment, and/or some other virtual environment. As used herein, a virtual environment is typically an environment that is accessible to a gamer tag and/or an environment in, with, and/or through which a gamer tag may exist, interact, and/or communicate.

Further, it will be understood that the phrase "gamer tag" may refer to a virtual identity (which may, in some embodiments, also be a real identity), gaming identity, user ID, profile, avatar, and/or the like that exists in, communicates with, has access to, etc. a virtual environment. It will be understood that a gamer tag may take any form, including any real and/or imaginary character string, word, name, number, profile, person, animal, plant, mineral, and/or any other known thing. In some embodiments, a gamer tag may identify and/or represent a gaming device user. In other embodiments, a gamer tag may identify and/or represent a gaming device, such as a serial number or name. In still other embodiments, a gamer tag may identify and/or represent a gaming device input device, such as a gaming console controller having a designation such as "Controller A". In some embodiments, a gamer tag may be controlled, operated, managed, and/or maintained (for simplicity, hereinafter "controlled") by a gaming device user. In other embodiments, a gamer tag may be controlled by an entity other than a gaming device user, such as a business, organization, and/or other entity. Further, in some embodiments, a gamer tag may be controlled via a gaming device and/or gaming device input device, but in other embodiments, any other method of controlling a gamer tag may be used.

In general terms, embodiments of the present invention relate to methods and apparatuses for using gamer tag information to execute, perform, broker, process, initiate, complete, and/or otherwise facilitate financial transactions. Exemplary financial transactions include, but are not limited to, buying/selling/trading gaming products (e.g., video games, online gaming subscriptions, video game T-shirts, and/or any other good and/or service associated with gaming), paying bills, transferring funds to and/or from financial accounts associated with other gamer tags, and/or any other kind of financial transaction, both/either related and/or unrelated to gaming. According to one embodiment, an intermediary system maintains a database that stores financial account information and corresponding gamer tag information for a plurality of gaming console users, as well as similar information for other individuals, businesses, and/or other entities. As such, the intermediary system is able to perform, execute, broker, process, initiate, complete, and/or otherwise facilitate financial transactions between, among, and/or involving entities having gamer tags so that those entities do not have to provide and/or expose their personal and/or financial account information to each other. In other embodiments, the intermediary system is alternatively or additionally configured so that entities having gamer tags are not inconvenienced by having to provide and/or expose their personal and/or financial account information to the intermediary system each time they engage in a financial transaction.

Referring now to FIG. 1, a general process flow 100 for an intermediary system is illustrated, in accordance with an embodiment of the present invention. As represented by the block 110, the intermediary system is configured to receive information associated with a first gamer tag, information associated with a second gamer tag, and information associated with a proposed financial transaction. The intermediary system may be configured to receive any amount and/or type of information associated with a first and/or second gamer tag, including, but not limited to, the first and/or second gamer tags themselves, names and/or images associated with the first and/or second gamer tags, activities of the first and/or second gamer tags, authentications and/or authorizations (e.g., usernames and passwords, etc.) associated with the first and/or second gamer tags, personal information associated with the entities controlling the first and/or second gamer tags, etc. In addition, an intermediary system having the process flow 100 may be configured to receive any information associated with a proposed financial transaction, including, but not limited to, information associated with the transaction format, transaction type, transaction amount, date to perform and/or facilitate the transaction, the one or more entities involved in the transaction, one or more authentications and/or authorizations for the transaction, etc. It will be understood that the, according to some embodiments, the information received by the intermediary system having the process flow 100 may be encrypted and/or otherwise secured.

It will be understood that an intermediary system having the process flow 100 may receive information from any source and/or in any known way. For example, in one embodiment, an intermediary system having the process flow 100 is configured to automatically receive information from a gaming device, such as a personal computer or mobile phone. As another example, the intermediary system is configured to receive information from a gaming console user via a gaming console. In another example, the intermediary system receives information from a financial institution, retail store, and/or some other organization via one or more user interface devices, such as, for example, those typically associated with a personal computer, network computer, mobile phone, and/or some other network entity. In still another example, the intermediary system receives information from some other system and/or device, which may in turn receive information from one or more other systems and/or devices, such as a gaming device and/or gaming console.

After receiving the gamer tag and financial transaction information, an intermediary system having the process flow 100 determines that the first gamer tag is associated with a first financial account and the second gamer tag is associated with a second financial account, as represented by the block 120. For example, in some embodiments, an intermediary system having the process flow 100 includes one or more datastores that store information associated with a plurality of financial accounts and/or a plurality of corresponding gamer tags. In this regard, the intermediary system may compare the received gamer tag information to the information stored in these one or more datastores in order to determine which gamer tags are associated with which financial accounts. It will be understood that, in such embodiments, the gamer tag and financial transaction information received by the intermediary system will not include any financial account information. In such embodiments, the intermediary system is configured to determine which financial accounts are associated with which gamer tags in order to perform or otherwise facilitate the proposed financial transaction.

However, in some embodiments, the information received by the intermediary system having the process flow 100 does include at least some financial account information. For example, in some embodiments, financial account information associated with one or more gamer tags, gaming device users, etc. is stored on a gaming device, and the gaming device is configured to communicate some or all of the financial account information to the intermediary system along with, included in, or separately from the gamer tag and/or financial transaction information. In other embodiments, a gaming device user inputs financial account information into a gaming device, and the gaming device communicates the financial account information to the intermediary system. In such embodiments, the intermediary system is configured to determine that the gamer tag is associated with the financial account as soon as the intermediary system receives, reads, and/or processes the received gamer tag information and financial account information. As another example, in some embodiments, a gaming device is configured to communicate at least some financial account information to the intermediary system in order to authenticate the identity of the gaming console user and/or authorize the facilitation of the proposed financial transaction. For example, a gaming console user may be required to communicate the last four digits of his financial account number before the intermediary system will facilitate a financial transaction involving his financial account.

After determining that the first and second gamer tags are associated with the first and second financial accounts, respectively, an intermediary system having the process flow 100 is configured to facilitate the financial transaction involving the first financial account and the second financial account, as represented by the block 130. It will be understood that the term "facilitate" is meant to be defined broadly to include any of the meanings of one or more of the following terms: initiate, complete, broker, process, finalize, execute, perform, affect, aid, ease, expedite, route, relay, communicate, simplify, speed up, authorize, regulate, manage, change, transform, conform, modify, control, manipulate, and/or the like. For example, it will be understood, according to one embodiment of the present invention, that the intermediary system having the process flow 100 may be configured to perform the financial transaction. As another example, according to one embodiment, the intermediary system may be configured to manage the proposed financial transaction by requesting and/or receiving at least one authorization and/or authentication associated with the first and/or second gamer tags and/or first and/or second gaming console users, and then approve, authorize, confirm, pass along, etc. the financial transaction for one or more other systems and/or entities to execute the financial transaction. Further, it will be understood that an intermediary system having the process flow 100 may be configured to facilitate any number and/or type of financial transactions, including, but not limited to, those involving real and/or virtual currency, real and/or virtual property, real and/or virtual goods, real and/or virtual services, and/or other consideration to buy, sell, and/or trade any real and/or virtual currency, real and/or virtual property, real and/or virtual goods, real and/or virtual services, and/or the like. Exemplary financial transactions include, but are not limited to, buying/selling/trading gaming products, transferring funds, paying bills, etc. In some embodiments, the intermediary system is additionally or alternatively configured to buy/sale/trade investments, such as stocks, bonds, mutual funds, options, etc.

It will also be understood that, by performing the process flow 100, the intermediary system having the process flow 100 is configured to act as an intermediary between and/or among one or more gaming console users, gaming consoles, gamer tags, financial accounts, financial institution customers, and/or financial institutions. For example, in some embodiments, where a bank maintains the first and second financial accounts, as well as the intermediary system having the process flow 100, the intermediary system is configured to act as an intermediary between the bank customers that hold those accounts. As another example, in some embodiments, where a first financial institution maintains the intermediary system and the first financial account (but not the second financial account), the intermediary system is configured to act as an intermediary between and/or among the first financial institution and other financial institutions and/or between and/or among customers of the first financial institution and/or customers of other financial institutions. As another example, in some embodiments, where a third party maintains the intermediary system, the intermediary system is configured to act as an intermediary between and/or among two or more financial institutions and/or between and/or among two or more customers of those two or more financial institutions. In such embodiments, the intermediary system provides a benefit to the financial institutions because the system facilitates transactions that involve financial institution financial accounts. In addition, the system also provides a benefit to the customers of those financial institutions because the system allows those customers to conveniently engage in financial transactions without providing and/or exposing their personal and/or financial information.

Of course, the order of the events described in the blocks 110, 120, and 130 in FIG. 1 may vary. For example, an intermediary system having the process flow 100 may receive information associated with a first gamer tag, second gamer tag, and proposed financial transaction before, after, or substantially simultaneous with determining that the first and second gaming tags are associated with the first and second financial accounts, respectively. In another embodiment, the intermediary system may facilitate the financial transaction before determining that the first and second gamer tags are associated with the first and second financial accounts. For example, in the event that the financial transaction includes transferring funds from the first financial account to the second financial account, an intermediary system having the process flow 100 may be configured to cover the transaction by transferring funds from a third financial account to the second financial account until it and/or another entity can determine the identity of the first financial account and debit funds from that account.

In some embodiments, the process flow 100 may include the additional step and/or event of receiving information associated with one or more authorizations and/or authentications before facilitating the financial transaction. (In some embodiments, the information associated with the proposed financial transaction may include information associated with one or more authorizations and/or authentications.) For example, in one embodiment, the intermediary system requires one or more of the parties involved in the financial transaction to authenticate their identities to the intermediary system before the intermediary system will facilitate the financial transaction. As another example, in one embodiment, an intermediary system having the process flow 100 requires one or more of the parties involved in the financial transaction to communicate an authorization to the intermediary system for the intermediary system to facilitate the financial transaction. For simplicity, it will be understood that the term "authentication", as used herein, also includes the term "authorization", even though the term "authorization" may also be used herein. Further, it will be understood that these one or more authentications may be received from one or more of the parties and/or systems involved in the financial transaction, as well as, or instead of, one or more other parties and/or systems.

It will be understood that these one or more authentications may be associated with one or more gamer tags, gaming devices, gaming device users, financial accounts, financial institution customers (which, in some embodiments, may also be gaming device users), and/or financial institutions. In some embodiments, the one or more authentications may take the form of providing and/or verifying one or more portions of personal and/or financial account information. In some embodiments, the one or more authentications may take the form of alphanumeric usernames and/or passwords. Still other examples include predetermined and/or requested gaming console-specific inputs, such as inputs into gaming console input devices having buttons, keys, dials, levers, directional pads, joysticks, accelerometers, microphones, touchpads, touchscreens, haptic interfaces, motion detectors, cameras, biosensors, and/or the like. It will be understood that authentications may be received by an intermediary system having the process flow 100 in any known way, such as, for example, via the Internet and/or other network communication, etc.

It will be understood that some embodiments of the present invention require user authentication methods that rely on user inputs to gaming console-specific input devices (e.g., gaming console controllers) to define the user's authentication. In these embodiments, additional security is provided to the user authentication process by having an authentication that is not easily intercepted and/or replicated. An additional benefit is foreseen in that these user authentication methods are more easily remembered by the gaming console user.

It will also be understood that some embodiments of the present invention require multiple authentications. For example, in one embodiment, an intermediary system having the process flow 100 requires two factors of authentication before it will facilitate a financial transaction: (1) a gaming console-specific identity, such as a serial number or name associated with the gaming console; and (2) a personal authentication associated with the gaming console user, gamer tag, and/or financial account associated with the gamer tag and/or gaming console user. In some embodiments, either or both of these factors of authentication may (or, in one embodiment, must) include gaming console-specific inputs into gaming console input devices. As another example, some embodiments require every gaming console user, business, and/or other party involved in the transaction to provide one or more authentications to the intermediary system before the intermediary system will facilitate the financial transaction. In other embodiments, authentication is required only from the one or more parties involved in the financial transaction, such as, for example, only those parties that transfer money to one or more other parties.

Referring now to FIG. 2, a high-level block diagram is provided to illustrate a system 200 for facilitating financial transactions using gamer tag information, in accordance with an embodiment of the present invention. As shown, the real world 210 includes a first gaming console user 211, a first gaming console 212, a second gaming console user 217, a second gaming console 216, a first financial institution 213, a second financial institution 215, and an intermediary system 218. Each of the first financial institution 213, second financial institution 215, first gaming console 212, and second gaming console 216 is operatively connected via a network (e.g., LAN, WAN, GAN, Internet, and/or the like) to the intermediary system 218. It will be understood that, although not shown, the first financial institution 213 and second financial institution 215 are operatively connected to the intermediary system 218 via one or more user interface systems, servers, and/or other network communication devices. Also, in one embodiment, the first financial institution 213 is distinct from the second financial institution 215, such that the institutions maintain separate and/or different financial accounts and provide services to separate and/or different customers. Accordingly, it will be understood that the first financial institution 213 maintains a first financial account 211*a* on behalf of the first gaming console user 211, and the second financial institution 215 maintains a financial account 217*a* on behalf of the second gaming console user 217. As also shown, the intermediary system 218 includes a datastore 219 that stores the financial account information and gamer tag information for the first gaming console user 211 and the second gaming console user 217.

In addition, FIG. 2 also shows a virtual environment 220 that is accessible to a first gamer tag 222 and a second gamer tag 226. It will be understood that the virtual environment 220 may include any one or more of the virtual environments described herein, including, but not limited to, a game world, virtual world, online gaming network, dashboard environment, LAN, WAN, GAN, Internet, network environment, and/or some other virtual environment. As shown, the first gamer tag 222 may exist in the virtual environment 220, and the first gaming console user 211 may use the first gaming console 212 in the real world 210 to control the first gamer tag 222 in the virtual environment 220. Likewise, the second gamer console user 217 may use the second gaming console 216 from the real world 210 to control the second gamer tag 226 in the virtual environment 220.

In operation, the intermediary system 218 may perform, execute, broker, initiate, process, and/or otherwise facilitate any type and number of financial transactions involving the first financial account 211*a* and the second financial account 217*a*. For example, in one embodiment, the intermediary system 218 may be configured to execute a transfer of funds from the first financial account 211*a* to the second financial account 217*a* and/or vice versa. As another example, where the first gamer tag 222 purchases real and/or virtual goods and/or services from the second gamer tag 226 in the virtual environment 220, the intermediary system 218 may be operable to route and/or otherwise communicate payment information to the first and/or second financial institutions 213, 215 so that either or both of those institutions may execute the transaction. It will also be understood that, in some embodiments, the intermediary system 218 may be configured to provide, on behalf of the first financial institution 213 and/or second financial institution 215, online banking services (and/or other financial services provided by financial institutions) to the gaming consoles 212, 216 and/or the users 211, 217.

In some embodiments, the intermediary system 218 and/or other portions of the system 200 is/are configured to implement any one or more embodiments of the process flow 100 as described herein. To illustrate a specific example, in one embodiment, the first gaming console user 211 may wish to transfer funds from his financial account 211*a* to a financial account associated with the second gamer tag 226. As such, the first gaming console user 211 may communicate the following information to the intermediary system 218 via the first gaming console 212: (1) information associated with the first gamer tag 222; (2) information associated with the second gamer tag 226; and (3) information associated with the funds transfer that will involve financial accounts associated with the first and second gamer tags 222 and 226.

Upon receiving this information, in accordance with an embodiment of the present invention, the intermediary system 218 may then determine, based at least partially on a comparison of the information received from the first gaming console user 211 to the information stored in the database 219, that the first gamer tag 222 is associated with the first financial account 211*a* and the second gamer tag 226 is associated with the second financial account 217*a*. Then, the intermediary system 218 may process the funds transfer itself and/or facilitate the funds transfer by communicating the relevant information (e.g, transfer amount, routing and account numbers of the financial accounts involved, etc.) to the first financial institution 213 and/or second financial institution 215, so that those institutions may communicate with each other via a financial network (not shown) and execute the transfer.

As shown from the preceding example, the first gaming console user 211 does not need to know any personal and/or financial account information associated with the second gamer tag 226 in order to engage in financial transactions with the second gamer tag 226 and/or any systems, devices, and/or parties associated with the second gamer tag 226 (and/or vice versa). Likewise, the first gaming console user 211 does not need to provide his personal and/or financial information to the intermediary system 218 each time he wishes to engage in a financial transaction. So long as the intermediary system 218 knows information about the financial transaction itself (e.g., transaction amount, which party is the payer/payee, etc.) and which gamer tags are involved in the transaction, the intermediary system 218 may facilitate the transaction by accessing the datastore 219 to determine which gamer tags are associated with which financial accounts. As such, embodiments of the present invention provide secure and/or convenient methods and apparatuses for facilitating financial transactions involving gaming console users and/or other entities having gamer tags.

It will be understood that entities other than gaming consoles and/or gaming console users may use the system 200. For example, in some embodiments, a retail store may control, via a user interface system, a virtual retail store having a gamer tag in the virtual environment 220, so that first and/or second gaming console users 211 and 217 may use the first and/or second gamer tags 222 and 226 to purchase real and/or virtual goods and/or services from the virtual retail store in the virtual environment 220. For example, in some embodiments, in the virtual environment 220, the first gaming console user 211 is able to use the first gamer tag 222 to order pizza, purchase sporting goods equipment, and/or engage in some other financial transaction with a gamer tag controlled by a retail store. As another example, in another embodiment, a video game publisher (and/or some other business that sells or otherwise deals in gaming products) may maintain a gamer tag in the virtual environment 220 so that other system users may purchase a video game, download gaming content, order a gaming strategy guide, etc. from the video game publisher via the virtual environment 220. In other embodiments, utility companies, apartment complexes, credit card companies, mobile phone providers, and/or any other type of business may maintain gamer tags that exist in the virtual environment 220 so that their gaming console using-customers may pay real bills using gamer tag information.

It will also be understood that embodiments of the system 200 may involve any kind and/or number of financial transactions and/or gamer tags. For example, in one embodiment, the first and second gamer tags 222 and 226 may be avatars that meet in a virtual or gaming world (the virtual environment 220) and agree that the first avatar will purchase virtual goods from the second avatar. In such a case, the first and/or second gaming console user controlling the first and/or second avatar may communicate gamer tag information and financial transaction information to the intermediary system 218 so that the first financial account 211*a* may be debited and the second financial account 217*a* may be credited. As another example, in another embodiment, the first and second gamer tags 222 and 226 are gaming profiles for use on an online gaming network (the virtual environment 220), where the first gamer tag 222 is controlled by a first gaming console user 211 and the second gamer tag 226 is associated with an online gaming network provider (not shown). In such a case, the first gaming console user 222 may use the system 200 and make a payment to a financial account associated with the second gamer tag 226 in order to purchase and/or renew access to the online gaming network (the virtual environment 220). It will be understood that, according to some embodiments, the first and second gamer tags 222 and 226 need not have access to and/or be present in the virtual environment 220 at the same time (or even at all) in order for them and/or entities associated with them to engage in financial transactions using the system 200.

It will also be understood that the intermediary system 218 may facilitate financial transactions in any way. For example, according to one embodiment, the intermediary system 218 may use information associated with the first and second financial accounts 211*a* and 217*a* to execute the financial transaction itself. As another example, in another embodiment, in the event of a funds transfer or payment, the intermediary system 218 may notify the receiver of the funds that the transfer is ready to be accepted, upon which the receiver may accept the transfer and the intermediary system 218, the first and second financial institutions 213, 215, and/or some other entity may execute the transfer. In still another embodiment, the intermediary system 218 may be configured to provide at least some financial account-identifying information to the first and/or second gamer tags, gaming consoles, and/or gaming console users, so that those entities may initiate, execute, process, and/or otherwise facilitate the financial transaction themselves. In yet another embodiment, the intermediary system 218 may request at least some personal and/or financial account information from a party and/or entity involved in the financial transaction in order to facilitate the financial transaction.

Also, as mentioned in connection with the process flow 100 illustrated in FIG. 1, it will be understood that any portion of the system 200 may be configured to request one or more authentications from any of the systems, devices, and/or entities associated with the system 200. For example, in one embodiment, the intermediary system 218 may require one or more factors of authentication from the first gaming console user 211 (e.g., a first gaming console identifier and/or a personal authentication) and/or the second gaming console user 217 before the intermediary system 218 will facilitate a financial transaction. In another embodiment, the system 200 may request and receive an authentication from the first and/or second financial institutions 213 and 215 before executing and/or facilitating financial transactions that involve financial accounts maintained by those institutions. It will be understood that an authentication may be valid for and/or tied to a particular transaction, gaming session, and/or any other period of time. In some embodiments, once a gaming console user provides satisfactory authentication information to the intermediary system 218, the user may forever thereafter use the gamer tag to engage in financial transactions involving the financial account. In other embodiments, the intermediary system 218 may require an authentication from the user before facilitating any financial transaction involving the financial account.

Further, it will be understood that gamer tags may be associated with financial accounts in any known way and/or at any time. For example, in one embodiment, the first gaming console user 211 may provide, via the first gaming console 212, financial account information, personal information, and/or authentication information to the intermediary system 218, so that the intermediary system 218 may associate the first gamer tag 222 with the first financial account 211*a*. In another embodiment, the intermediary system 218 requests and receives one or more portions of this information from the first financial institution 213 instead of, or in addition to, the first gaming console user 211. In some embodiments, gamer tags may be associated with financial accounts at the start of a gaming session, during a gaming session, and/or outside of a gaming session. In addition, according to other embodiments, gamer tags may be associated with financial accounts outside of the system 200 altogether, such as, for example, by using a personal computer operatively connected to the intermediary system 200 via the Internet.

It will also be understood that other embodiments of the present invention may include different configurations than those shown in FIG. 2. For example, in one embodiment, the intermediary system 218, first financial institution 213, and/or second financial institution 215 may be operatively connected to the virtual environment 220 for any purpose, including, for example, communicating gamer tag and transaction information and/or maintaining gamer tags. As another example, according to another embodiment, the first financial institution 213 and the second financial institution 215 may be operatively connected to a financial network (e.g., an interbank network for communicating transaction information) to which the intermediary system 218 may or may not be operatively connected. In other embodiments, the first financial institution 213 and the second financial institution 215 are the same financial institution.

It will be understood that some or all of the portions of the system 200 may be combined into a single portion, e.g., the first gaming console 212 and the second gaming console 216 may be combined into a single gaming console (e.g., a public gaming console, arcade game machine, etc.) configured to perform all of the same functions of those separate portions as described herein. Likewise, some or all of the portions of the system 200 may be separated into two or more distinct portions, e.g., the intermediary system 218 may be separated into a payment processing system and a financial account and gamer tag information datastore system.

In addition, the various devices, systems, and/or entities of the system 200 may be held, controlled, operated, managed, serviced, stored, maintained, etc. (herein "maintained" for simplicity) by the same or separate parties. For example, in one embodiment, the first gaming console user 211 is a consumer and maintains the gaming console 212, the second gaming console user 217 is an employee of a retail store that maintains the second gaming console 216, and the first financial institution 213 maintains the intermediary system 218. As another example, in another embodiment, the first financial institution 213 and the second financial institution 215 are the same financial institution, the first gaming console user 211 is a customer of the financial institution and maintains the first gaming console 212, the second gaming console user 217 is also a customer of the financial institution and maintains the second gaming console 216, and the financial institution maintains the first financial account 211*a*, the second financial account 217*a*, and the intermediary system 218.

Referring now to FIG. 3, a system 300 for facilitating financial transactions using gamer tag information is provided, in accordance with an embodiment of the present invention. As illustrated, the system 300 includes an online gaming network 310, a first gaming console 320, a bank intermediary system 330, a video game publisher 340, a retail store 350, and a second gaming console 360. Each of the portions of the system 300 may be selectively and operatively connected to the online gaming network 310, which may include one or more separate online gaming networks and/or other virtual environments. It will also be understood that, in accordance with some embodiments, the online gaming network 310 may be provided by the online gaming network server 312 and/or some other network device. It will also be understood that, although not shown, the video game publisher 340, the retail store 350, and the second gaming console 360 are operatively connected to the online gaming network 310 via one or more user interface systems, servers, and/or other network devices. In addition, the online gaming network 310 may be accessible via a LAN, WAN, and/or GAN, such as the Internet. It will be understood that the online gaming network 310 may be secure and/or unsecure and may also include wireless and/or wireline technology. Further, it will be understood that other embodiments of the present invention may include any kind of virtual environment, as defined herein, in place of, or in addition to, the online gaming network 310.

As illustrated in FIG. 3, the gaming console 320 includes a communication interface 322, a processor 324, a memory 326 having a gaming console dashboard application 327 and gaming console datastore 328 stored therein, and a gaming console input device 329. The communication interface 322 is operatively connected to the processor 324, which is operatively connected to the gaming console input device 329 and the memory 326.

Each communication interface described herein, including the communication interface 322, generally includes hardware, and, in some instances, software, that enables a portion of the system 300, such as the first gaming console 320, to transport, send, receive, and/or otherwise communicate information to and/or from the communication interface of one or more other portions of the system 300. For example, the communication interface 322 of the first gaming console 320 may include a modem, server, electrical connection, and/or other electronic device that operatively connects the first gaming console 320 to another electronic device, such as the electronic devices that make up the bank intermediary system 330.

Each processor described herein, including the processor 324, generally includes circuitry for implementing the audio, visual, and/or logic functions of that portion of the system 300. For example, the processor may include a digital signal processor device, a microprocessor device, and various analog-to-digital converters, digital-to-analog converters, and other support circuits. Control and signal processing functions of the system in which the processor resides may be allocated between these devices according to their respective capabilities. The processor may also include functionality to operate one or more software programs based on computer-executable program code portions thereof, which may be stored, for example, in a memory device, such as in the gaming console dashboard application 327 of the memory 326 of the first gaming console 320.

Each memory device described herein, including the memory 326 for storing the gaming console dashboard application 327 and other data, may include any computer-readable medium. For example, memory may include volatile memory, such as volatile random access memory (RAM) having a cache area for the temporary storage of data. Memory may also include non-volatile memory, which may be embedded and/or may be removable. The non-volatile memory may additionally or alternatively include an EEPROM, flash memory, and/or the like. The memory may store any one or more of pieces of information and data used by the system in which it resides, such as the first gaming console 320, to implement the functions of the system within which the memory resides, such as the first gaming console 320.

As shown in FIG. 3, the memory 326 includes the gaming console dashboard application 327. In one embodiment, the gaming console dashboard application is operable to communicate with the bank intermediary system 330 and/or one or more other portions of the system 300. For example, the gaming console dashboard application 327 may be operable to communicate information, including, but not limited to, gamer tag information, personal information, and/or financial account information to and/or from the online gaming network 310 and/or other portions of the system 300. In some embodiments, the gaming console application 327 is operable to establish a secure connection with the bank intermediary system 330 and/or any other portion of the system 300. In some embodiments, the gaming console dashboard application 327 is operable for the purposes of facilitating financial transactions. In some embodiments, the gaming console dashboard application 327 is operable to provide a dashboard environment and/or some other graphical user interface to a gaming console user. In some embodiments, the gaming console application 327 is operable to allow the gaming console user to navigate, use, control, and/or operate the first gaming console 320 and/or a gamer tag (not shown) in the online gaming network 310, in a dashboard environment in the first gaming console 320, and/or in some other virtual environment. In some embodiments, the gaming console dashboard application 327 is operable to deliver financial services to the user of the gaming console, including, but not limited to, those services described herein in relation to using gamer tag information to facilitate financial transactions, as well as conventional financial services like online banking, bill pay services, investment transaction services, account balance services, and/or the like. In some embodiments, the gaming console dashboard application 327 includes computer-executable program code portions for instructing the processor 324 to perform any one or more of the functions of the gaming console dashboard application 327 described herein. In some embodiments, the gaming console dashboard application 327 may include and/or use one or more network and/or system communication protocols.

It will be understood that, in some embodiments, the gaming console dashboard application 327 includes signed code and is specifically configured for the first gaming console 320 on which it is implemented. The gaming console dashboard application 327 may also include a signed application certificate that may serve to establish identity by associating a public key to the application, assign authority by establishing what actions the application may take based upon the certificate, and secure confidential information. In general, the certificate may include a public key, a name, an expiration date, the name of an issuing authority, a serial number, any relevant policies describing how the certificate may be used, the digital signature of the certificate issuer and any other pertinent information.

In addition to the gaming console dashboard application 327, the memory 326 also includes the gaming console datastore 328. The gaming console datastore 328 may include any one or more storage devices, including, but not limited to, datastores, databases, and/or any of the other storage devices typically associated with a computer system. In one embodiment, the gaming console datastore 328 includes gamer tag information, personal information, financial account information, gaming information, gaming console information, online gaming network information, and/or any other type and/or amount of information typically stored in a gaming console. For example, the gaming console datastore 328 may include information associated with saved games, gamer tag usernames and passwords, online gaming network Internet Protocol (IP) addresses and passcodes, and/or personal and/or financial account information associated with one or more gaming console users. In another embodiment, the gaming console datastore 328 may include information associated with one or more gaming console applications, such as, for example, a financial services application provided by a financial institution and/or the gaming console dashboard application 327. It will be understood that, in at least some embodiments of the present invention, the gaming console datastore 328 provides a substantially real-time representation of the information stored therein, so that when the processor 324 accesses the gaming console datastore 328, the information stored therein is current or substantially current.

The gaming console input device 329 may include one or more buttons, keys, dials, levers, directional pads, joysticks, accelerometers, microphones, touchpads, touchscreens, haptic interfaces, microphones, scanners, motion detectors, cameras, and/or the like for receiving information from a gaming console user. In some embodiments, the gaming console input device 329 includes a controller specific to the first gaming console 320 that is configured to receive gaming console-specific inputs, such as a series of controller or joystick movements, from the gaming console user. For example, in one embodiment, the first gaming console 320 comprises the Nintendo® WHO and the gaming console input device 329 comprises a Wii Remote®. Also, in some embodiments, the gaming console input device 329 may include one or more output devices, including, for example, a display and/or speaker for presenting information to a gaming console user.

Also illustrated in FIG. 3 is a bank intermediary system 330, in accordance with an embodiment of the present invention. According to one embodiment, as shown, the bank intermediary system 330 is maintained by a bank for the benefit of its customers. However, it will be understood that, in other embodiments, the bank intermediary system 330 may be maintained by another entity and/or for the benefit of other consumers and/or customers of other entities. For example, in another embodiment not shown, the bank intermediary system 330 is maintained by Bank A and provides services to customers of Bank A, as well as to the customers of Bank B and the customers of Bank C.

The bank intermediary system 330 may include, for example, a portion of a computer network, a network device, an engine, a platform, a server, a database system, a front end system, a back end system, a personal computer system, and/or some other type of computing device and/or system. In one embodiment, as illustrated in FIG. 3, the bank intermediary system 330 includes a communication interface 332, a processor 334, and a memory 336, which includes an intermediary application 337 and a gamer tag and financial account datastore 338 stored therein. As shown, according to one embodiment, the communication interface 332 is operatively connected to the processor 334, which is operatively connected to the memory 336.

The intermediary application 337, according to some embodiments of the present invention, is operable to communicate with the first gaming console 320 and/or any one or more other portions of the system 300. In another embodiment, the intermediary application 337 is operable to perform, execute, broker, process, initiate, complete, and/or otherwise facilitate financial transactions. For example, in one embodiment, the intermediary application 337 is operable to determine that one or more financial accounts are associated with one or more gamer tags. It will be understood that the intermediary system 337 may make these determinations in any known way. For example, according to some embodiments of the present invention, the intermediary system 337 is operable to compare gamer tag information communicated to the bank intermediary system 330 to information stored in the gamer tag and financial account database 338 in order to determine which one or more financial accounts are associated with the gamer tag information communicated. However, in other embodiments, the intermediary application 337 may be configured to map, link, and/or otherwise associate gamer tag information to financial account information in other ways, including, for example, by receiving financial account-identifying information from gaming console users, gaming consoles, financial institutions, and/or other entities. In other embodiments, the intermediary application 337 may be operable to use at least some personal information, such as, for example, the last four digits of gaming console users' social security numbers, in order to determine which financial accounts correspond to which gamer tags.

Of course, the intermediary application 337 may also be configured to make other determinations and/or perform other functions. For example, the intermediary application 337 may be operable to determine that gamer tag information communicated to the bank intermediary system 330 is associated with one or more gaming consoles, gaming console users, authentications, and/or financial institutions, in accordance with other embodiments of the present invention. Likewise, in some embodiments, the intermediary application 337 is operable to determine that one or more authentications are associated with one or more gamer tags, gaming consoles, gaming console users, financial accounts, and/or financial institutions. As another example, the intermediary application 337 may also include instructions associated with how and when to facilitate a financial transaction and/or instructions relating to the display of a financial transaction in an online banking account and/or some other graphical user interface providing information associated with a financial account. It will be understood that, in some embodiments, the intermediary application 337 includes computer-executable program code portions for instructing the processor 334 to perform any one or more of the functions of the intermediary application 337 described herein. In some embodiments, the intermediary application 337 may include and/or use one or more network and/or system communication protocols.

In addition to the intermediary application 337, the memory 336 also includes the gamer tag and financial account datastore 338. The gamer tag and financial account datastore 338 may include any one or more storage devices, including, but not limited to, datastores, databases, and/or any of the other storage devices typically associated with a computer system. The gamer tag and financial account datastore 338 may include any type and/or amount of information related to the functions of the one or more portions of the bank intermediary system 330, as described herein. For example, in one embodiment, the gamer tag and financial account datastore 338 includes gamer tag information, financial account information, personal information, gaming information, gaming console information, online gaming network information, and/or the like. As another example, in one embodiment, the gamer tag and financial account datastore 338 includes information associated with which gamer tags are associated with which financial accounts, which gaming consoles are associated with which gamer tags and/or financial accounts, which financial accounts are associated with which gaming console users, and so on. It will be understood that the gamer tag and financial account datastore 338 may store information in any known way, such as, for example, by using one or more computer codes and/or languages, alphanumeric character strings, data sets, figures, tables, charts, links, documents, and/or the like. In some embodiments, the gamer tag and financial account datastore 338 may include information associated with one or more applications, such as, for example, a financial services application provided by a financial institution and/or the intermediary application 337. It will be understood that, in at least some embodiments of the present invention, the gamer tag and financial account datastore 338 provides a substantially real-time representation of the information stored therein, so that when the processor 334 accesses the gamer tag and financial account datastore 338, the information stored therein is current or substantially current.

It will be understood that any number of other systems, devices, and/or other persons, organizations, and/or other entities may also be operatively connected to the online gaming network 310. For example, as shown in FIG. 3, the system 300 may include the video game publisher 340, the retail store 350, and the second gaming console 360, where each is operatively connected to the online gaming network 310. The video game publisher 340 and the retail store 350 may be operatively connected to the online gaming network 310 via any known method, such as, for example, via a user interface system, a server, a personal computer system, and/or some other network device. In general terms, these network devices will typically include a communication interface, a processor, and a memory, as described herein.

The second gaming console 360 may also include a communication interface, a processor, and a memory, as described herein. In addition, the second gaming console 360 may be of the same type and/or have the same functions as the first gaming console 320, but in other embodiments, it may also be different. Like the first gaming console 320, in some embodiments, the second gaming console 360 may additionally or alternatively comprise a gaming device, such as, for example, a personal computer system, mobile phone, and/or the like.

The inclusion of the video game publisher 340, the retail store 350, and the second gaming console 360 are to illustrate that a variety of other devices and/or entities may be operatively connected to the online gaming network 310. Each of these devices and/or entities may, in some embodiments, have and/or be associated with gamer tags and/or financial accounts, such that the bank intermediary system 330 may facilitate financial transactions on their behalf. For example, in one embodiment, the video game publisher 340 controls a gamer tag in the online gaming network 310 so that a gamer tag, gaming console, gaming console user, and/or any other device and/or entity may purchase goods, such as video games, and/or services related to gaming from the video game publisher 340. As another example, the retail store 350 may also control a gamer tag in the online gaming network 310 so that other devices and/or entities operatively connected to the online gaming network 310 may purchase, sell, trade, and/or otherwise deal in virtual and/or real goods and/or services with the retail store. As another example, a first gaming console user may use a first gamer tag associated with the first gaming console 320 to transfer money from a first financial account to a second financial account associated with the second gaming console 360 and/or a second gamer tag, second gaming console user, and/or financial account associated with the second gaming console 360. Of course, it will be understood that the bank intermediary system 330 may facilitate each of these financial transactions, as well as many others not described in detail herein.

It will be understood that the system 300 may comprise any embodiments of the system 200 described herein and/or may implement any embodiment of the process flow 100 described herein. It will also be understood that some or all of the portions of the system 300 may be combined into a single portion. Likewise, some or all of the portions of the system 300 may be separated into two or more distinct portions. In addition, the various portions of the system 300 may be maintained by the same or separate entities. Further, in addition to FIG. 3, other embodiments of the system 300 may take the form of some other configuration and/or involve any other number of devices and/or entities.

Referring now to FIG. 4, a more-detailed process flow 400 of a system configured to facilitate a funds transfer from a first financial account to a second financial account using gamer tag information is illustrated, in accordance with an example embodiment of the present invention. In this embodiment, it will be understood that the first financial account is controlled by a first gaming console user and associated with a first gamer tag, and the second financial account is controlled by a second gaming console user and associated with a second gamer tag. It will also be understood that the first financial institution maintains the first financial account for the benefit of the first gaming console user, and the second financial institution (which is not related to the first financial institution) maintains the second financial account for the benefit of the second gaming console user.

As represented by the block 406, a first gaming console user uses the first gaming console 401 to log on to an online gaming network. As represented by the block 410, the first gaming console user then accesses an intermediary system interface that is accessible to the user via the online gaming network. Then, as represented by the block 415, the first gaming console user uses the interface to request the funds transfer by sending information associated with the first gamer tag, information associated with the second gamer tag, information associated with the funds transfer, and information associated with an authentication to the intermediary system 402.

After receiving the information from the first gaming console user via the first gaming console 401, the intermediary system 402 is configured to determine that the authentication is associated with the first gamer tag, as represented by the block 420. In addition, as represented by the block 425, the intermediary system 402 is also configured to determine that the first gamer tag is associated with the first financial account and the second gamer tag is associated with the second financial account. Further, as represented by the block 430, the intermediary system 402 is configured to communicate information associated with the funds transfer (e.g., transfer amount, identity of transferee/transferor, etc.) and information associated with the first and second financial accounts (e.g., routing numbers and account numbers, etc.) to the first financial institution 404.

After receiving the information from the intermediary system 402, the first financial institution 404 authorizes the funds transfer and then sends notification of the authorization back to the intermediary system 402, as represented by the block 435. After receiving this notification, the intermediary system 402 is configured to send notification to the first gaming console user via the first gaming console 401 and to the second gaming console user via the second gaming console 403 that the funds transfer was authorized, as represented by the blocks 440, 445, and 450. Then, as represented by the block 455, the first financial institution 404 and/or the second financial institution 405 act, either directly and/or via one or more intermediaries, to execute the funds transfer from the first financial account to the second financial account.

It will be understood that if one or more portions of the system having the process flow 400 are not able to perform any one or more aspects of the process flow 400, then the funds transfer may not be executed. For example, if the intermediary system 402 is not able to determine that the authentication is associated with the first gamer tag, then the intermediary system 402 may be configured not to communicate any funds transfer or financial account information to the first financial institution 404. As another example, if the first financial institution 404 is not able to authorize the funds transfer because, for example, the first financial account lacks enough funds, then the first financial institution 404 may not execute the funds transfer.

It will also be understood that any one or more aspects of the process flow 400, and/or one or more of the components in the system having the process flow 400, may be configured differently, in accordance with any one or more of the embodiments of the present invention described herein. For example, in one embodiment, the intermediary system 402 is configured to request and receive authentication from the second gaming console user via the second gaming console 403 before communicating any funds transfer and financial account information to the first financial institution 404. As another example, in another embodiment, the intermediary system 402 is configured to request and receive authorization (and/or another form of authentication, etc.) from the first and/or second financial institutions. As another example, in another embodiment, the intermediary system 402 is configured to execute the funds transfer itself. Of course, it will also be understood that the system having the process flow 400 may include other components in addition to, or instead of, those illustrated in FIG. 4.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A system for facilitating a proposed financial transaction between a first party associated with a first gamer tag and a second party associated with a second gamer tag, the system comprising:

a storage device comprising the first gamer tag, the second gamer tag, a first real financial account, a second real financial account, a first gaming device identifier, and a second gaming device identifier;

an electronic communication interface configured to:

receive, from a first gaming device, information associated with the first gamer tag, information associated with the second gamer tag, information associated with the proposed financial transaction, and the first gaming device identifier; and receive, from a second gaming device, the second gaming device identifier; and a processor operatively connected to the communication interface and configured to:

determine that the first gamer tag is associated with the first real financial account and the second gamer tag is associated with the second real financial account;

authenticate the first gamer tag to the first gaming device identifier, wherein authentication is based on at least one gaming console controller;

send to the second gaming device a communication comprising the proposed financial transaction;

authenticate the second gamer tag with the second gaming device identifier, wherein authentication is based on the at least one gaming console controller; and facilitate the proposed financial transaction outside a virtual environment, responsive to receiving permission to facilitate the proposed financial transaction from the second gaming device, based at least partially on the processor determining that the first gamer tag is associated with the first real financial account, determining that the second gamer tag is associated with the second real financial account, authenticating the first gamer tag to the first gaming device identifier, and authenticating the second gamer tag to the second gaming device identifier, wherein the proposed financial transaction outside the virtual environment involves a payment in real currency from the first real financial account to the second real financial account, and wherein the payment is for one or more real goods or services;

wherein the first gamer tag corresponds to a first avatar of the first party that is present in the virtual environment;

wherein the second gamer tag corresponds to a second avatar of the second party that has no access to the virtual environment.

2. The system of claim 1, wherein the gaming device comprises a gaming console.

3. The system of claim 1, wherein the processor is configured to facilitate the proposed financial transaction by executing the proposed financial transaction.

4. The system of claim 1, wherein the processor is configured to facilitate the proposed financial transaction by communicating information associated with the proposed financial transaction and information associated with the first real financial account to a computerized apparatus configured to execute the proposed financial transaction.

5. The system of claim 4, wherein the computerized apparatus is maintained by a financial institution that maintains the first real financial account and the second real financial account.

6. The system of claim 1, wherein the processor is configured to determine that the first gamer tag is associated with the first real financial account based at least partially on a comparison of the information associated with the first gamer tag to information stored in a datastore, wherein the datastore comprises information associated with a plurality of gamer tags and a plurality of real financial accounts.

7. The system of claim 1, wherein the communication interface is operatively connected to the gaming device via the Internet, and wherein the communication interface is configured to receive, from the gaming device via the Internet, the information associated with the first gamer tag and the information associated with the proposed financial transaction.

8. The system of claim 1, wherein the payment comprises transferring funds or credit from the first real financial account to the second real financial account.

9. The system of claim 1, wherein the processor is configured to facilitate the proposed financial transaction by transferring funds or credit from the first real financial account to the second real financial account.

10. The system of claim 1, wherein the first gamer tag is controlled by a first gaming device user, the second gamer tag is controlled by a business, and the proposed financial transaction comprises purchasing a gaming product.

11. A method for facilitating a proposed financial transaction between a first party associated with a first gamer tag and a second party associated with a second gamer tag, the method comprising:

storing, in a database, the first gamer tag, the second gamer tag, a first real financial account, a second real financial account, a first gaming console identifier, and a second gaming console identifier using a processor;

receiving, from a first gaming console, information associated with the first gamer tag, information associated with the second gamer tag, information associated with the proposed financial transaction, and the first gaming console identifier;

determining, using a processor, that the first gamer tag is associated with the first real financial account and that the second gamer tag is associated with the second real financial account;

authenticating the first gaming tag to the first gaming console identifier using a processor, wherein authentication is based on at least one gaming console controller;

sending to the second gaming console a communication comprising the proposed financial transaction using a processor;

receiving from the second gaming console permission to facilitate the proposed financial transaction and the second gaming console identifier using a processor;

authenticating the second gamer tag to the second gaming console identifier using a processor, wherein authentication is based on the at least one gaming console controller; and facilitating the proposed financial transaction outside a virtual environment based at least partially on the determining that the first gamer tag is associated with the first real financial account, the determining that the second gamer tag is associated with the second real financial account, the authenticating the first gamer to the first gaming console identifier, and the authenticating the second gamer tag to the second gaming console identifier, wherein the proposed financial transaction outside the virtual environment involves a payment in real currency from the first real financial account to the second real financial account, and wherein the payment is for one or more real goods or services;

wherein the first gamer tag corresponds to a first avatar of the first party that is present in the virtual environment;

wherein the second gamer tag corresponds to a second avatar of the second party that has no access to the virtual environment.

12. The method of claim 11, wherein the determining that the first gamer tag is associated with the first real financial account is based at least partially on a comparison of the information associated with the first gamer tag to information stored in a datastore, wherein the information stored in the datastore comprises information associated with a plurality of gamer tags and a plurality of real financial accounts.

13. The method of claim 11, wherein the authentication comprises one or more gaming console-specific inputs.

14. The method of claim 11, wherein the first gamer tag is associated with a user of the gaming console, wherein the user of the gaming console is a holder of the first real financial account, wherein the first gamer tag comprises a virtual identity of the user within the virtual environment, and wherein the virtual environment is accessible to the user via the gaming console.

15. The method of claim 11, wherein the facilitating the proposed financial transaction comprises transferring funds or credit from the first real financial account to the second real financial account.

16. The method of claim 11, wherein the first gamer tag is controlled by a first gaming device user, the second gamer tag is controlled by a business, and the proposed financial transaction comprises purchasing a gaming product.

17. The method of claim 11, wherein the proposed financial transaction comprises at least one of purchasing a gaming product, transferring funds, or paying a bill.

18. A computer program product for facilitating a proposed financial transaction between a first party associated with a first gamer tag and a second party associated with a second gamer tag, the computer program product comprising a non-transitory computer-readable medium having computer-executable program code portions stored therein, wherein the computer-executable program code portions comprise:

a first program code portion configured to store, in a storage device, the first gamer tag, the second gamer tag, a first real financial account, a second real financial account, a first gaming device identifier, and a second gaming device identifier;

a second program code portion configured to receive, from a first gaming device, information associated with the first gamer tag, information associated with the second gamer tag, information associated with the proposed financial transaction, and first gaming device identifier;

a second program code portion configured to determine (i) that the first gamer tag is associated with the first real financial account and that the second gamer tag is associated with the second real financial account;

a third program code portion configured to authenticate the first gamer tag to the first gaming device identifier, wherein authentication is based on at least one gaming console controller;

a fourth program code portion configured to send to the second gaming device a communication comprising the proposed financial transaction;

a fifth program code portion configured to receive from the second gaming device permission to facilitate the proposed financial transaction and the second gaming device identifier;

a sixth program code portion configured to authenticate the second gamer tag to the second gaming device identifier, wherein authentication is based on the at least one gaming console controller; and a seventh program code portion configured to facilitate the proposed financial transaction outside a virtual environment based at least partially on the determination that the first gamer tag is associated with the first real financial account and the determination that the second gamer tag is associated with the second real financial account, the authentication of the first gamer tag to the first gaming device identifier, and the authentication of the second gamer tag to the second gaming device identifier, wherein the proposed financial transaction outside the virtual environment involves a payment in real currency from the first real financial account to the second real financial account, and wherein the payment is for one or more real goods or services;

wherein the first gamer tag corresponds to a first avatar of the first party that is present in the virtual environment;

wherein the second gamer tag corresponds to a second avatar of the second party that has no access to the virtual environment.

19. A method comprising:

providing a financial services application that executes on a first gaming device and enables a first party to make a payment from a first real financial account held by the first party to a second real financial account held by a second party outside a virtual environment without requiring the first party to input information into the financial services application identifying the first real financial account;

storing, in a storage device and using a processor, a first gamer tag, a second gamer tag, the first real financial account, the second real financial account, a first gaming device identifier, and a second gaming device identifier;

receiving, from the first gaming device and via the financial services application, a payment amount associated with the payment, a first gamer tag associated with the first party, a second gamer tag associated with the second party, and the first gaming device identifier;

determining, using a processor, that the first gamer tag is associated with the first real financial account and that the second gamer tag is associated with the second real financial account;

authenticating, using a processor, the first gamer tag to the first gaming device identifier, wherein authentication is based on at least one gaming console controller;

sending to a second gaming device a communication comprising information associated with the payment using a processor;

receiving from the second gaming device permission to facilitate the payment and the second gaming device identifier using a processor;

authenticating, using a processor, the second gamer tag to the second gaming device identifier, wherein authentication is based on the at least one gaming console controller; and facilitating the payment from the first real financial account to the second real financial account outside the virtual environment based at least partially on the determining that the first gamer tag is associated with the first real financial account, the determining that the second gamer tag is associated with the second real financial account, the authenticating the first gamer tag to the first gaming device identifier, and the authenticating the second gamer tag to the second gaming device identifier;

wherein the payment involves a payment in real currency from the first real financial account to the second real financial account, and wherein the payment is for one or more real goods or services;

wherein the first gamer tag corresponds to a first avatar of the first party that is present in the virtual environment;

wherein the second gamer tag corresponds to a second avatar of the second party that has no access to the virtual environment.

20. The method of claim 19, wherein the facilitating the payment comprises transferring funds or credit from the first real financial account to the second real financial account in accordance with the payment amount.

21. The method of claim 19, wherein the financial services application further enables the first party to make a payment from the first real financial account to the second real financial account without requiring the first party to input information into the financial services application identifying the second real financial account.

22. The system of claim 1, wherein the first avatar is in the form of a plant or mineral.

* * * * *